US007538643B2

(12) United States Patent
Mizutani

(10) Patent No.: US 7,538,643 B2
(45) Date of Patent: May 26, 2009

(54) SWITCH CIRCUIT

(75) Inventor: Hiroshi Mizutani, Kanagawa (JP)

(73) Assignee: NEC Electronic Corporation, Kanagawa (JP)

( * ) Notice: Subject to any disclaimer, the term of this patent is extended or adjusted under 35 U.S.C. 154(b) by 189 days.

(21) Appl. No.: 11/498,788

(22) Filed: Aug. 4, 2006

(65) Prior Publication Data

US 2007/0030101 A1 Feb. 8, 2007

(30) Foreign Application Priority Data

Aug. 8, 2005 (JP) ..... 2005-229931

(51) Int. Cl.
*H01P 1/15* (2006.01)

(52) U.S. Cl. ..... 333/262; 333/103

(58) Field of Classification Search ..... None
See application file for complete search history.

(56) References Cited

U.S. PATENT DOCUMENTS 4,673,831 A * 6/1987 Reppen ..... 327/374
6,288,620 B1 * 9/2001 Atokawa et al. ..... 333/103
2002/0180556 A1 * 12/2002 Watanabe et al. ..... 333/126
2006/0145779 A1 * 7/2006 Furuta ..... 333/103

FOREIGN PATENT DOCUMENTS

JP 09-093001 A 4/1997
JP 11-074703 A 3/1999
JP 2004072362 A * 3/2004

* cited by examiner

*Primary Examiner*—Benny Lee
*Assistant Examiner*—Alan Wong
(74) *Attorney, Agent, or Firm*—Sughrue Mion, PLLC

(57) ABSTRACT

A switch circuit 1 includes a unit circuit including capacitors 12, 14, an inductor 20, and a FET 30 (switching element). The capacitors 12, 14 are provided in a path P1 (first path) connecting I/O terminals 92, 94. The capacitors 12, 14 are serially connected to each other. To the path P1, a path P2 (second path) is connected. The path P2 includes the inductor 20 and the FET 30, which are serially connected to each other. To be more detailed, an end of the inductor 20 is connected to a connection point N, and the drain (or source) of the FET 30 is connected to the other end of the inductor 20. The source (or drain) of the FET 30 is grounded.

9 Claims, 19 Drawing Sheets

SWITCH CIRCUIT

This application is based on Japanese patent application No. 2005-229931, the content of which is incorporated hereinto by reference.

BACKGROUND

1. Technical Field

The present invention relates to a switch circuit.

2. Related Art

Japanese Laid-open patent publications No.H11-74703 (patent document 1) and No.H09-93001 (patent document 2) disclose switch circuits for use under a millimeter-wave band (30 to 300 GHz) that include a field-effect transistor (hereinafter, FET) serving as a switching element. In the switch circuits, the FET appears to be an ON resistance between the source and the drain when the channel is open, and can be handled as an OFF capacitance between the source and the drain when pinched off. The switch circuit according to the patent document 1 is a high-pass type switch circuit designed based on characteristics of a high-pass filter. On the other hand, the switch circuit according to the patent document 2 utilizes a LC serial resonance of an inductor and the OFF capacitance of the FET.

FIG. 15 is a circuit diagram of the switch circuit according to the patent document 1. The switch circuit includes FETs 103, 104 in a path connecting input/output (hereinafter, I/O) terminals 101 and 102. The FETs 103, 104 are serially connected to each other, so that the source of either is connected to the drain of the other. To a connection point A between the FETs 103, 104, an end of an inductor 105 is connected, with the other end grounded. In the switch circuit thus configured, ON and OFF are switched upon applying a common voltage to the respective gate of the FETs 103, 104, through a resistor 106.

When the FETs 103, 104 are pinched off, a circuit constituted of the respective OFF capacitance of the FETs 103, 104 and the inductor 105 becomes identical to an equivalent circuit of a T-type high-pass filter, as shown in FIG. 16. Under such state, accordingly, the switch circuit of FIG. 15 presents a low loss characteristic in a frequency range not lower than the cutoff frequency, and the switch is turned ON. In contrast, when the channels of the FETs 103, 104 are open, the impedance of the circuit formed by the ON resistance of the FETs 103, 104 provokes a matching loss, and the switch is turned OFF.

FIG. 17 is a circuit diagram of the switch circuit according to the patent document 2. The switch circuit includes transmission lines 113 to 115 serially connected to one another, in a path connecting I/O terminals 111, 112. Between a connection point of the transmission lines 113, 114 and the ground, two paths are provided. One of the paths includes a FET 116, and the other path includes a FET 117 and a transmission line 118. Likewise, between a connection point of the transmission lines 114, 115 and the ground, a path including a FET 119 and a path including a FET 120 and a transmission line 121 are provided. The gates of the FETs 116, 119 are mutually connected, so that between a connection point thereof and a bias terminal 122, a transmission line 123 is provided. Likewise, the gates of the FETs 117, 120 are mutually connected so that between a connection point thereof and a bias terminal 124, a transmission line 125 is provided.

Here, the characteristic impedance of the transmission lines 113, 114, 115, 118, 121, 123 and 125 is 50Ω. The length of the transmission lines 123, 125 is equal to a quarter of a wavelength (hereinafter, λ/4), at an operating frequency.

The switch circuit thus configured is turned ON and OFF by switching the open channel state and the pinched-off state of the shunted FETs 116, 119 and the FETs 117, 120. When the FETs 116, 119 are pinched off and the channels of the FETs 117, 120 are open, the equivalent circuit can be expressed as FIG. 18A. As is apparent from FIG. 18A, the shunt circuit gains high impedance because of the LC parallel resonance, and the switch is turned ON. When the states of the FETs 116, 119 and the FETs 117, 120 are reversed, the equivalent circuit turns to what is shown in FIG. 18B. As is apparent from FIG. 18B, because of the LC serial resonance of the transmission lines 118, 121 acting as the inductor and the OFF capacitance of the FETs 116, 119, the shunt circuit becomes short-circuited, and the switch is turned OFF.

SUMMARY OF THE INVENTION

The ON resistance of the FET is generally as small as several to somewhere below 20Ω, and hence a plurality of circuit units shown in FIG. 15 has to be serially connected, in order to obtain a sufficient isolation characteristic in the switch circuit according to the patent document 1. Accordingly, approx. 10 to 20 pieces of active elements are necessary for constituting the entire circuit. Consequently, a relatively large chip size is required when constituting such switch circuit for use under a low frequency such as 100 GHz or lower. This is quite disadvantageous in reducing the cost.

In turn, in the switch circuit according to the patent document 2, when either pair of the shunted FETs 116, 119 or the FETs 117, 120 is in the open channel state, the other pair is pinched off, as already stated. Employing thus two lines of FETs complicates wiring arrangement of a bias line. Such disadvantage becomes particularly apparent in a branch type switch such as a single pole n-throw (hereinafter, SPnT) switch. Complication of the bias line wiring leads to an increase in area of the circuit region, thus resulting in an increase in chip size.

According to the present invention, there is provided a switch circuit comprising a unit circuit, including a capacitor provided in a first path connecting I/O terminals; an inductor provided in a second path having an end connected to the first path and the other end grounded; and a switching element provided in the second path and serially connected to the inductor.

In the switch circuit thus configured, the switching element appears to be an ON resistance when it is ON. Accordingly, the capacitor and the inductor constitute a high-pass filter, so that the impedance of the first path, which serves as a signal line, becomes generally 50Ω. Thus, the switch circuit is turned ON. In contrast, the switching element appears to be an OFF capacitance when it is OFF. Accordingly, the OFF capacitance and the inductor cause serial resonance, and the second path becomes short-circuited. This causes the signal to be totally reflected at the connection point of the first and the second paths, thereby achieving high isolation performance. Thus, the switch circuit is turned OFF.

The switch circuit according to the present invention achieves, as described above, a high isolation characteristic because of the resonance of the inductor and the switching element serially connected to each other. Therefore, unlike the switch circuit shown in FIG. 15, there is no need to serially connect a plurality of unit circuits for improving the isolation. Further, unlike the switch circuit shown in FIG. 17, the switch circuit according to the present invention can be turned ON and OFF with the switching element of a single line. This prevents the complication of the bias line wiring.

Thus, the present invention provides a switch circuit that enables implementation of the relevant chip in a reduced size.

BRIEF DESCRIPTION OF THE DRAWINGS

The above and other objects, advantages and features of the present invention will be more apparent from the following description taken in conjunction with the accompanying drawings, in which.

DETAILED DESCRIPTION

Figure 1:
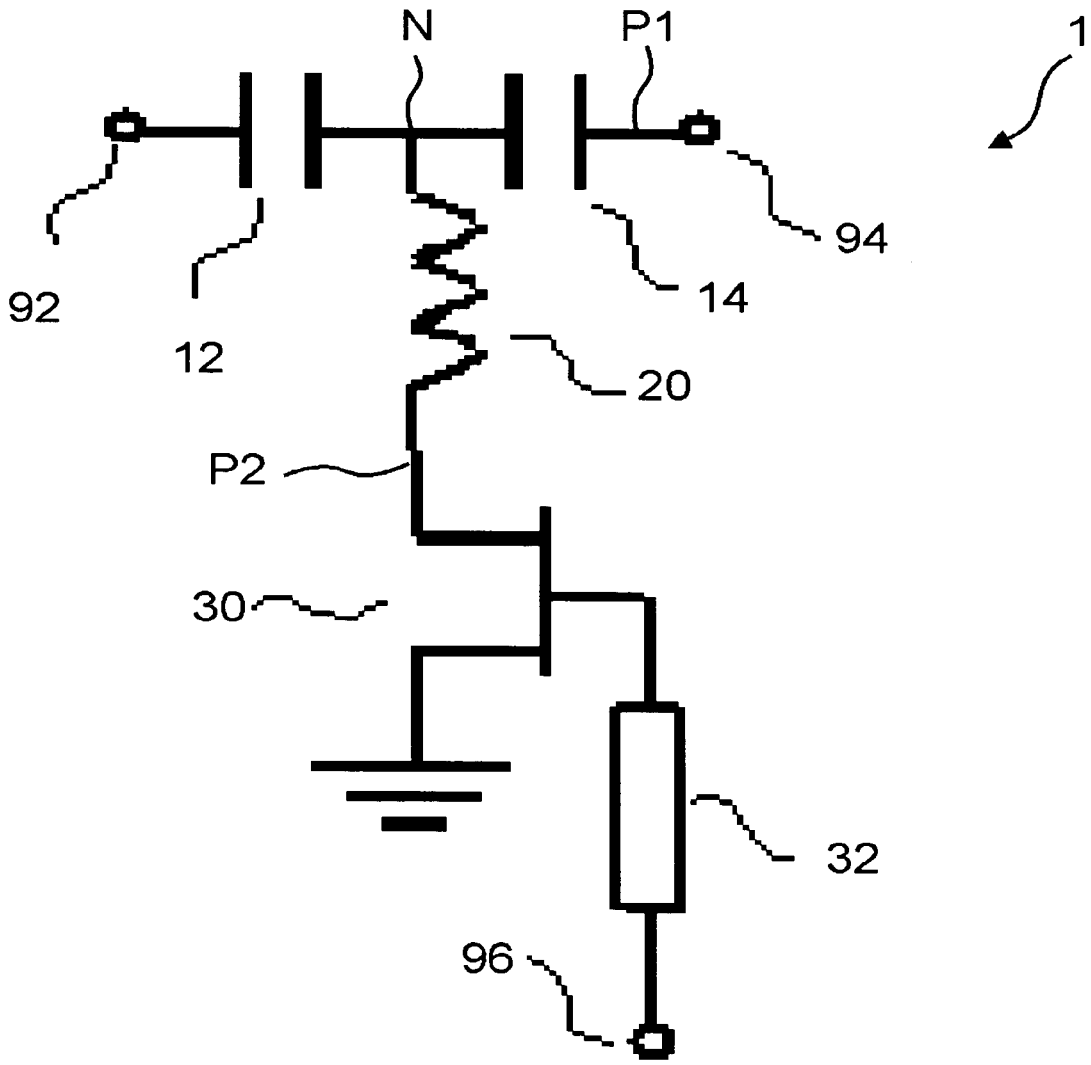
FIG. 1 is a circuit diagram of a switch circuit according to the first embodiment of the present invention.

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Hereunder, exemplary embodiments of a switch circuit according to the present invention will be described in details, referring to the accompanying drawings. In the drawings, same constituents are given the identical numerals, and duplicating description may be omitted where appropriate.

FIRST EMBODIMENT

FIG. 1 is a circuit diagram of a switch circuit according to the first embodiment of the present invention. The switch circuit 1 includes a unit circuit having capacitors 12, 14, an inductor 20, and a FET 30 (switching element), applicable to a system for a microwave band and a millimeter-wave band, for example. The switch circuit 1 is a single pole single throw (hereinafter, SPST) switch that includes just one of such unit circuit.

The capacitors 12, 14 are provided in a path P1 (first path) connecting I/O terminals 92, 94. The capacitors 12, 14 are serially connected to each other. To the path P1, a path P2 (second path) is connected. A connection point N of the path P1 and the path P2 is located between the capacitor 12 and the capacitor 14.

The path P2 includes the inductor 20 and the FET 30, which are serially connected to each other. To be more detailed, an end of the inductor 20 is connected to the connection point N, and the drain (or source) of the FET 30 is connected to the other end of the inductor 20. The source (or drain) of the FET 30 is grounded. The gate of the FET 30 is connected to a control terminal 96 via a transmission line 32 (RF isolation circuit). The transmission line 32 is a $\lambda/4$ line having a length equal to a quarter of the propagation wavelength of the operating frequency. Here, a resistance may be employed in place of the transmission line 32, to constitute the RF isolation circuit. To the control terminal 96, a control voltage is input so as to switch ON/OFF of the FET 30. Switching the high and low level of the control voltage enables switching ON/OFF of the switch circuit 1.

An operation of the switch circuit 1 will be described hereunder, along with a result of operation simulation of the switch circuit 1. In the simulation, the threshold voltage of the FET 30 was set at −1 V. The capacitance C of the capacitors 12, 14 was set at 0.2 pF, the inductance L of the inductor 20 at 0.22 nH, the OFF capacitance $C_{off}$ of the FET 30 at 0.02 pF, and the ON resistance $R_{on}$ of the FET 30 at 13Ω.

Figure 2A:
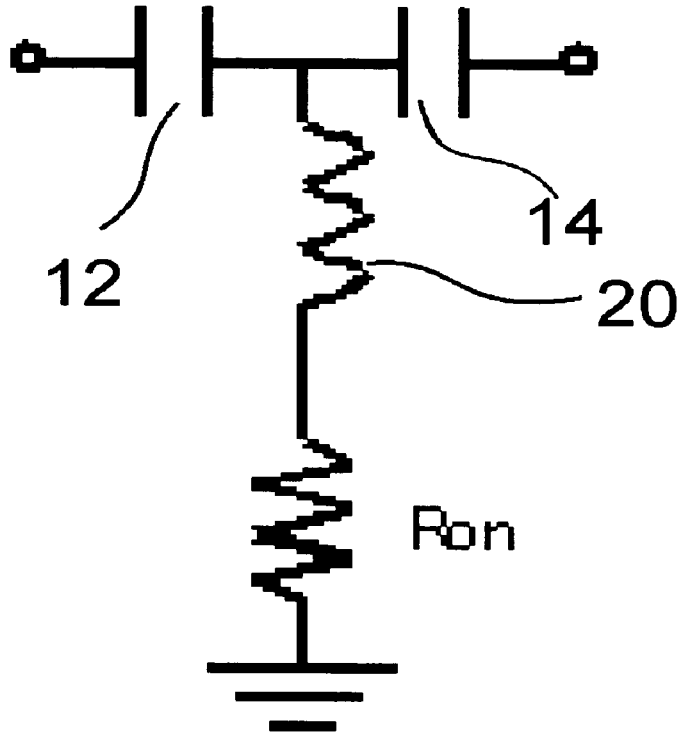
FIGS. 2A and 2B are equivalent circuit diagrams of the switch circuit of FIG. 1, the former in an ON state and the latter in an OFF state.
Figure 3A:
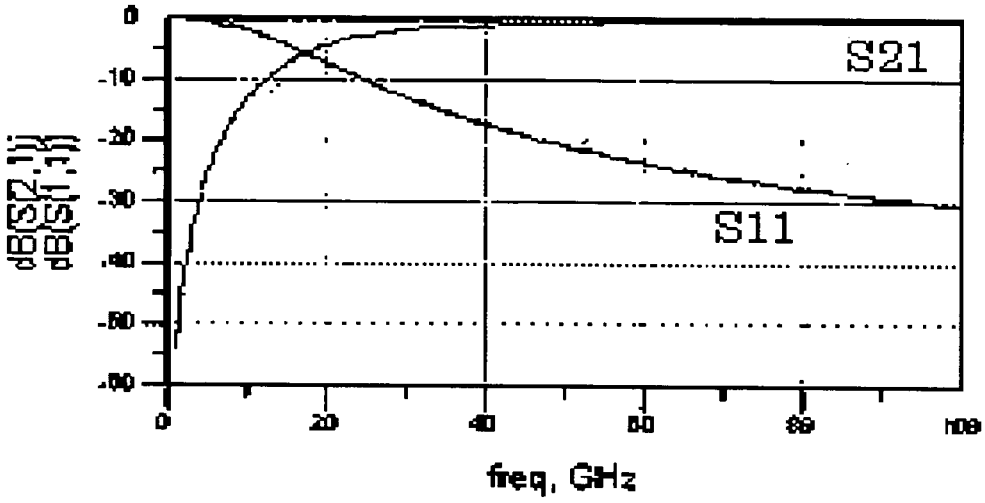
FIGS. 3A and 3B are graphs showing an operation simulation result of the switch circuit of FIG. 1.

Upon applying 0 V to the control terminal 96 the switch circuit 1 is turned ON, and such state can be expressed as an equivalent circuit shown in FIG. 2A. The capacitors 12, 14 and the inductor 20 constitute a T-type high-pass filter, so that the impedance between the I/O terminals 92, 94 comes close to 50Ω at the cutoff frequency of 24 GHz or higher. Under such state, the transmission characteristic of the RF signal between the I/O terminals 92, 94 is expressed as a small signal frequency characteristic typically seen in a high-pass filter, as indicated by the line S21 in FIG. 3A. Thus, significantly low loss was achieved, such as 0.26 dB at 76 GHz.

Figure 2B:
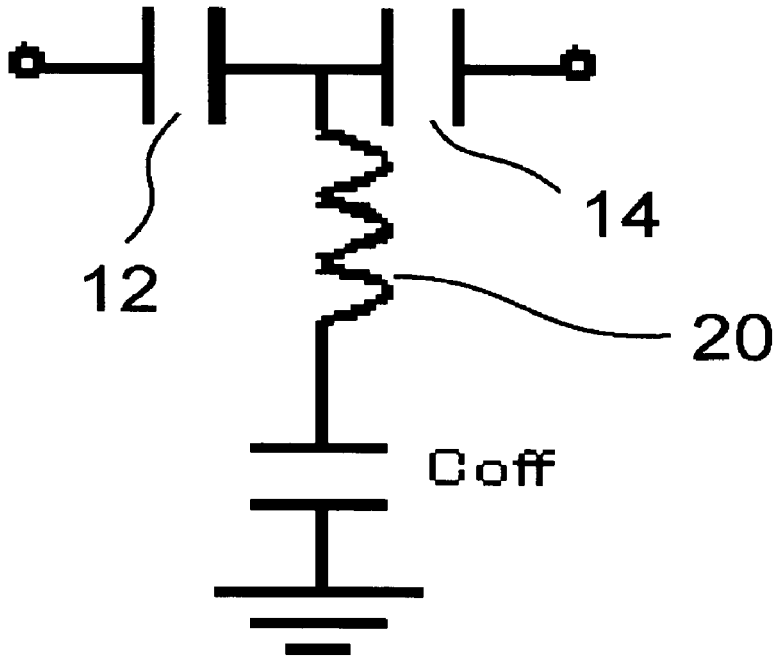
Figure 3B:
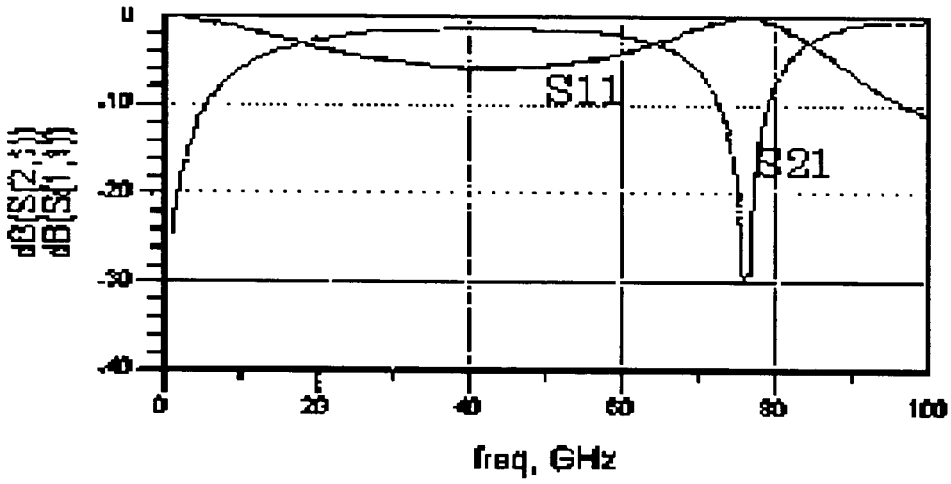

Upon applying, on the other hand, −5V to the control terminal 96 the switch circuit 1 is turned OFF and such state can be expressed as an equivalent circuit shown in FIG. 2B. Because of the serial resonance of the inductor 20 and the OFF capacitance of the FET 30, a short circuit occurs at the connection point N. Accordingly, the RF signal input through the I/O terminal 92 or the I/O terminal 94 is totally reflected by the connection point N, thus to be blocked between the I/O terminals 92, 94. FIG. 3B shows a transmission characteristic of the RF small signal between the I/O terminals 92, 94. From FIG. 3B, it is apparent that the signal is blocked by the serial resonance of the inductor 20 and the OFF capacitance of the FET 30 at 76 GHz. Thus, an isolation characteristic as high as 37.5 dB at 76 GHz was achieved.

Figure 15:
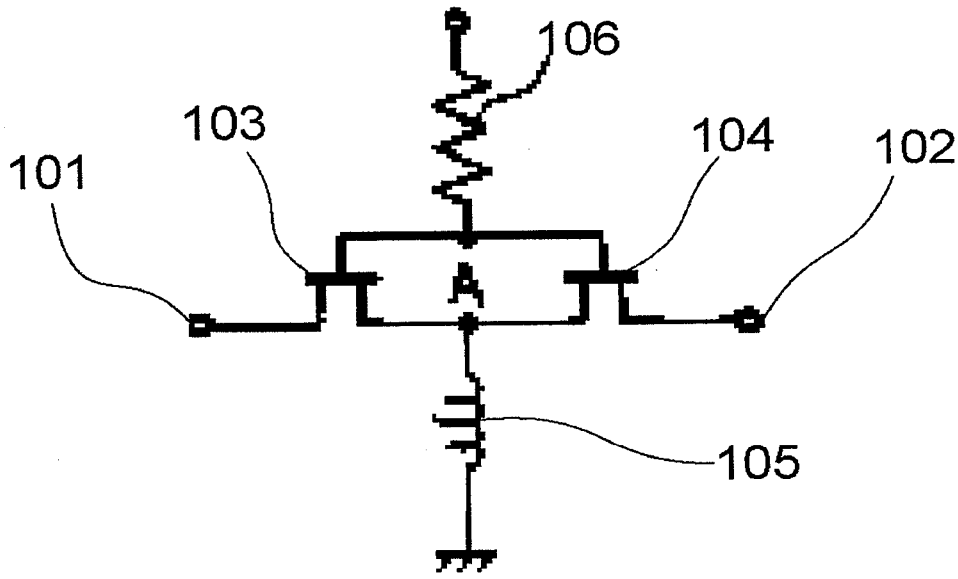
FIG. 15 is a circuit diagram of a switch circuit according to the patent document 1.
Figure 16:
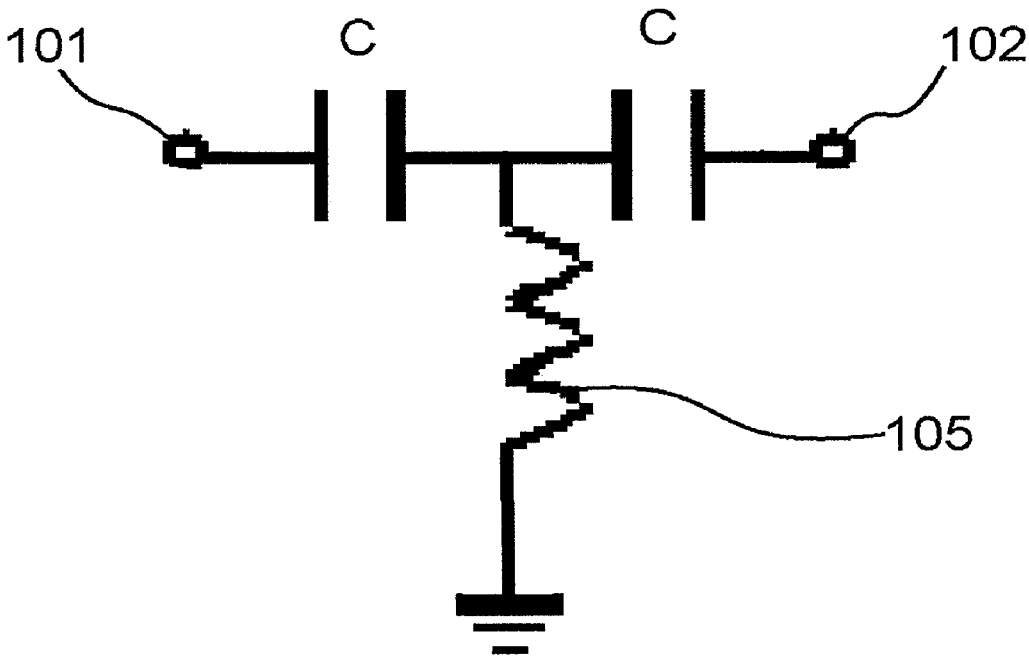
FIG. 16 is an equivalent circuit diagram of the switch circuit of FIG. 15 in an ON state.

The switch circuit 1 offers the following advantages. The switch circuit 1 provides a high isolation characteristic, based on the resonance of the inductor 20 and the OFF capacitance of the FET 30, which are serially connected. Therefore, unlike the switch circuit shown in FIG. 15, there is no need to serially connect a plurality of unit circuits for improving the isolation, even at a frequency of 100 GHz or lower. Actually, as shown in FIG. 3B, the isolation characteristic as high as 37.5 dB could be achieved with a quite small chip including just one FET 30.

Figure 17:
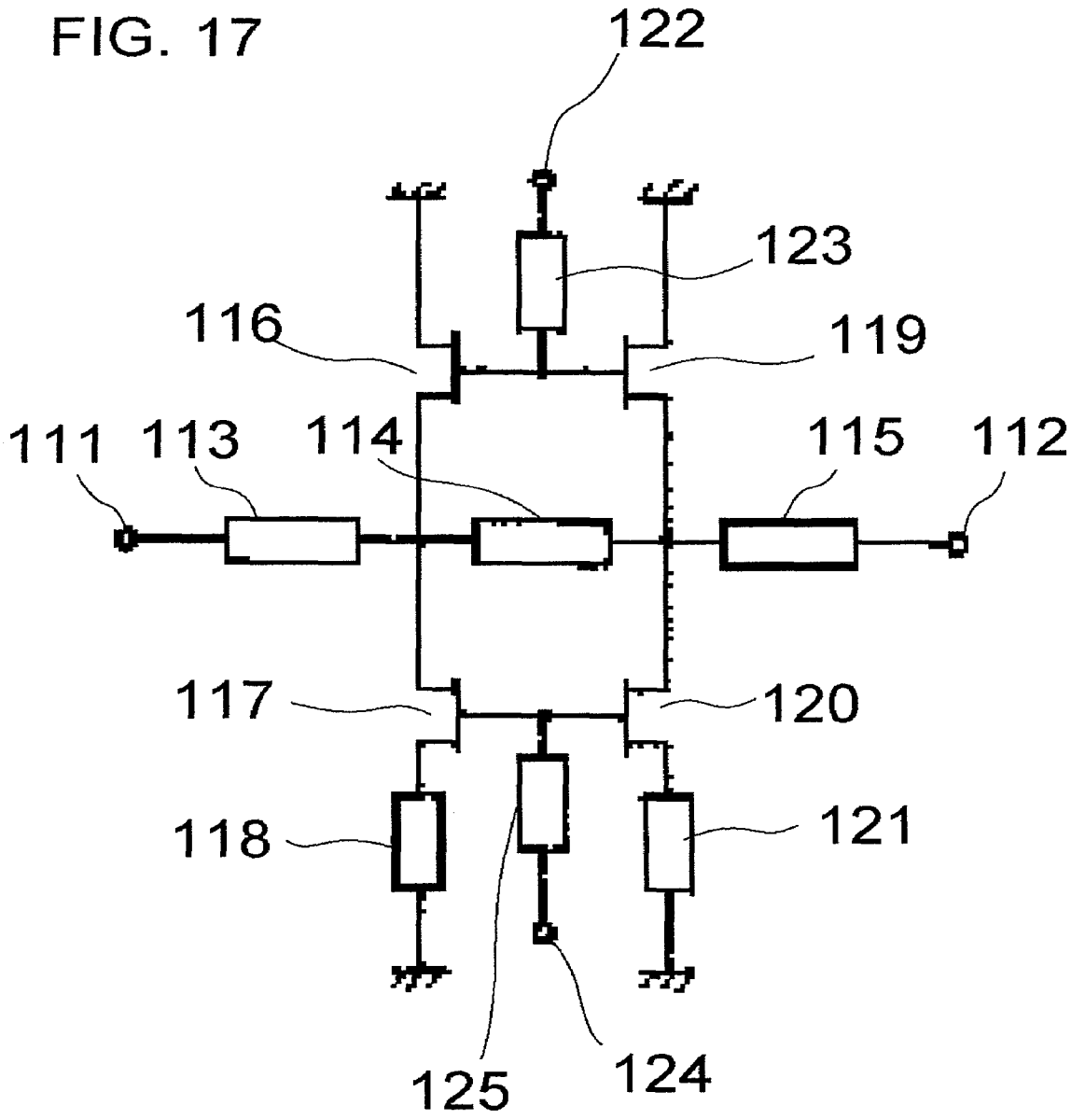
FIG. 17 is a circuit diagram of a switch circuit according to the patent document 2.
Figure 18A:
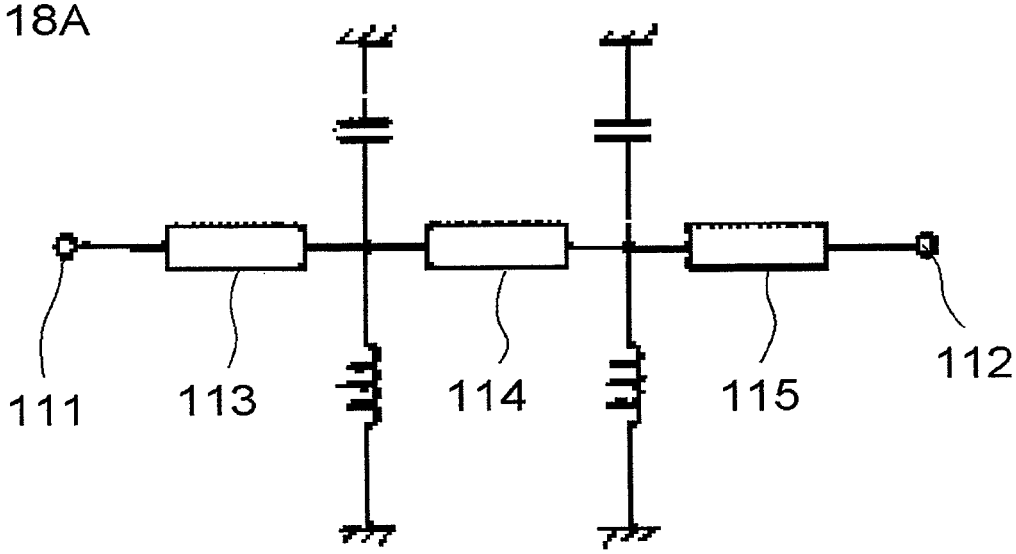
FIGS. 18A and 18B are equivalent circuit diagrams of the switch circuit of FIG. 17, the former in an ON state and the latter in an OFF state.
Figure 18B:
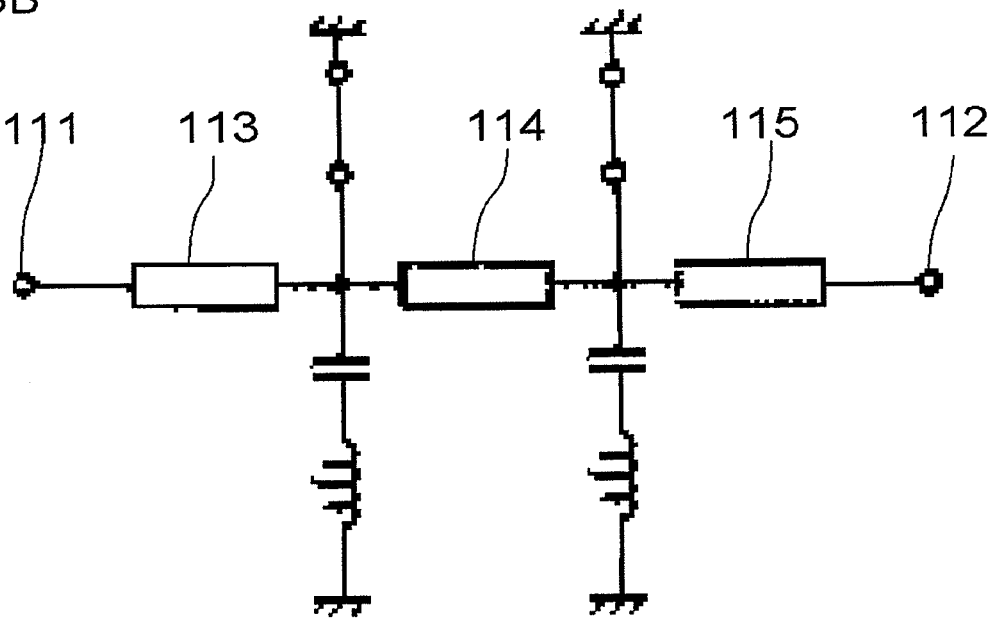

Also, unlike the switch circuit shown in FIG. 17, the switch circuit 1 can be turned ON and OFF with the FET 30 of a single line. This prevents the complication of the bias line wiring, even when constituting a SPnT switch. Thus, the switch circuit 1 enables implementation of the relevant chip in a reduced size. This also results in reduction in manufacturing cost of the switch circuit 1.

Further, since the switch circuit 1 includes just one line of the FET 30, fluctuation in production quality of the FET, if any, barely affects the performance of the switch circuit 1. Besides, since the switch circuit 1 includes just one FET 30, such advantage is further enhanced. On the contrary, the switch circuit 2 shown in FIG. 17 which includes two lines of FET is susceptible to the fluctuation in production quality of the FET. This results in a lower yield from the production. From such viewpoint, the switch circuit 1 provides a higher yield because of the minimized influence of the fluctuation in production quality of the FET.

Thus, the foregoing embodiment provides the switch circuit 1 which is small in size and offers a high yield from the production, as well as excellently performs even in a millimeter-wave band. Many switch circuits that operate under a high frequency (especially in a millimeter-wave band) have been developed so far, however it has been quite difficult to build such switch circuits in a reduced size. This is because, as stated referring to FIGS. 15 and 17, the circuit requires a number of elements. In particular, the conventional switch circuits that utilize the resonance require numerous pieces of active elements, which may lead to a poorer yield because of fluctuation in production quality of the active elements. This may constitute a serious obstacle in reducing the cost of a millimeter-wave monolithic IC (hereinafter, MMIC) switch. It is, therefore, significant to reduce the number of active elements that constitute the millimeter-wave switch, not only for reducing the chip size but also for securing a desired yield, without being affected by the fluctuation in production quality of the elements.

Further, the path P1 includes two capacitors 12, 14, and the connection point N of the path P1 and the path P2 is located between the capacitors 12, 14. Such arrangement leads to formation of a complete high-pass circuit when the switch circuit 1 is turned ON, thus resulting in a lower insertion loss characteristic. However, the unit circuit may include just one capacitor. In other words, only one of the capacitors 12, 14 may be provided in the unit circuit. In such case also, the switch circuit 1 can equally act as a virtual high-pass filter circuit.

To constitute the switching element, a diode is often employed instead of the FET. The switch circuit according to the present invention may include the diode instead of the FET. In general, reducing the ON resistance and OFF capacitance of the active elements is necessary for upgrading the performance of a microwave or millimeter-wave band switch circuit. In this reference, employing a PIN diode is advantageous because a lower resistance and a lower capacitance can be thereby relatively easily achieved. On the other hand, the FET has the advantage of higher compatibility with a heterojunction transistor process for building a majority of the MMIC, and of lower power consumption. Selection of the switching element is to be properly made according to requirements of the system.

SECOND EMBODIMENT

Figure 4:
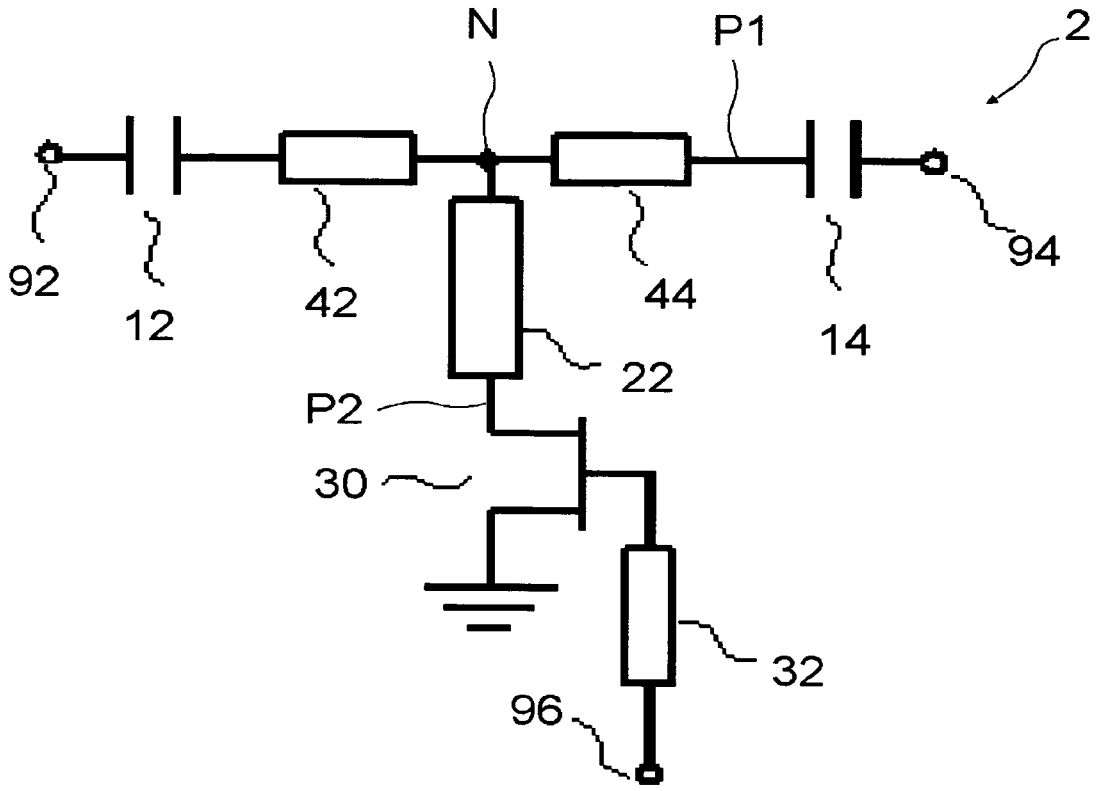
FIG. 4 is a circuit diagram of a switch circuit according to the second embodiment of the present invention.

FIG. 4 is a circuit diagram of a switch circuit according to the second embodiment of the present invention. The switch circuit 2 is a SPST switch that includes a unit circuit including the capacitors 12, 14, a transmission line 22 (inductor), and the FET 30. The path P1 includes transmission lines 42, 44 in addition to the capacitors 12, 14. The capacitor 12, the transmission line 42, the transmission line 44 and the capacitor 14 are serially connected to one another in this sequence.

The path P2 includes the transmission line 22 and the FET 30 serially connected to each other. To be more detailed, an end of the transmission line 22 is connected to the connection point N, and the drain (or source) of the FET 30 is connected to the other end of the transmission line 22. The source (or drain) of the FET 30 is grounded. The gate of the FET 30 is connected to the control terminal 96 via the transmission line 32. The transmission line 22 acts as an inductor. In other words, the inductor is constituted of a distributed constant line in the switch circuit 2.

An operation of the switch circuit 2 will be described hereunder, along with a result of operation simulation of the switch circuit 2. In the simulation, a GaAs FET (threshold voltage −1V, gate width 100 μm) having a heterojunction was employed. The GaAs substrate was formed in a thickness of 40 μm. The width and length of the transmission lines 42, 44 were set at 25 μm and 30 μm, respectively. The width and length of the transmission line 22 were set at 15 μm and 235 μm respectively. The capacitors 12, 14 were formed in a MIM structure with the width and length of 70 μm, and the capacitance per unit area was set at 300 pF/mm$^2$. Also, the OFF capacitance $C_{off}$ of the FET 30 was set at 0.02 pF, and the ON resistance $R_{on}$ of the FET 30 at 13Ω.

Figure 5A:
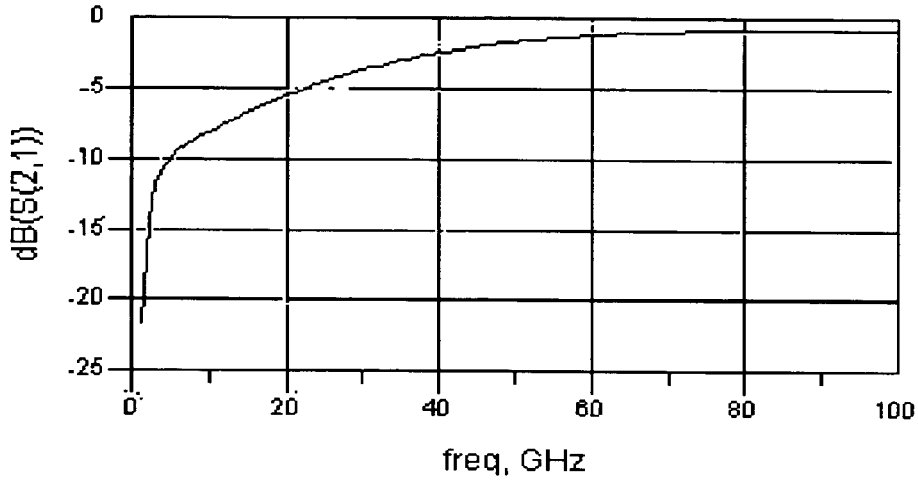
FIGS. 5A and 5B are graphs showing an operation simulation result of the switch circuit of FIG. 4.

Upon applying 0 V to the control terminal 96 the switch circuit 2 is turned ON, and the capacitors 12, 14 and the transmission line 22 constitute a T-type high-pass filter. The impedance between the I/O terminals 92, 94 comes close to 50Ω at the cutoff frequency (approx. 38 GHz) or higher. Under such state, the transmission characteristic of the RF signal between the I/O terminals 92, 94 is expressed as a small signal frequency characteristic typically seen in a high-pass filter, as shown in FIG. 5A. Thus, a significantly low loss characteristic was achieved, such as 0.84 dB at 76 GHz.

Figure 5B:
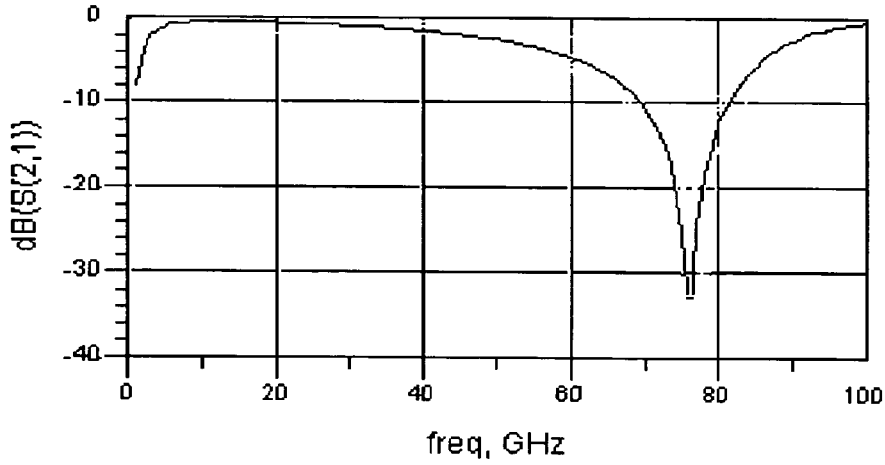

Upon applying, on the other hand, −5V to the control terminal 96, the switch circuit 2 is turned OFF. Because of the serial resonance of the transmission line 22 and the OFF capacitance of the FET 30, a short circuit occurs at the connection point N. Accordingly, the RF signal input through the I/O terminal 92 or the I/O terminal 94 is totally reflected by the connection point N, thus to be blocked between the I/O terminals 92, 94. FIG. 5B shows a transmission characteristic of the RF small signal between the I/O terminals 92, 94. From FIG. 5B, it is apparent that at 76 GHz the signal is blocked by the serial resonance of the transmission line 22 and the OFF capacitance of the FET 30. Thus, an isolation characteristic as high as 35.9 dB at 76 GHz was achieved.

The switch circuit 2 thus configured offers the following advantage, in addition to those offered by the switch circuit 1. Since the inductor is constituted of a distributed constant line (transmission line 22) in the switch circuit 2, the switch circuit 2 is particularly suitable for operation under a millimeter-wave band.

THIRD EMBODIMENT

Figure 6:
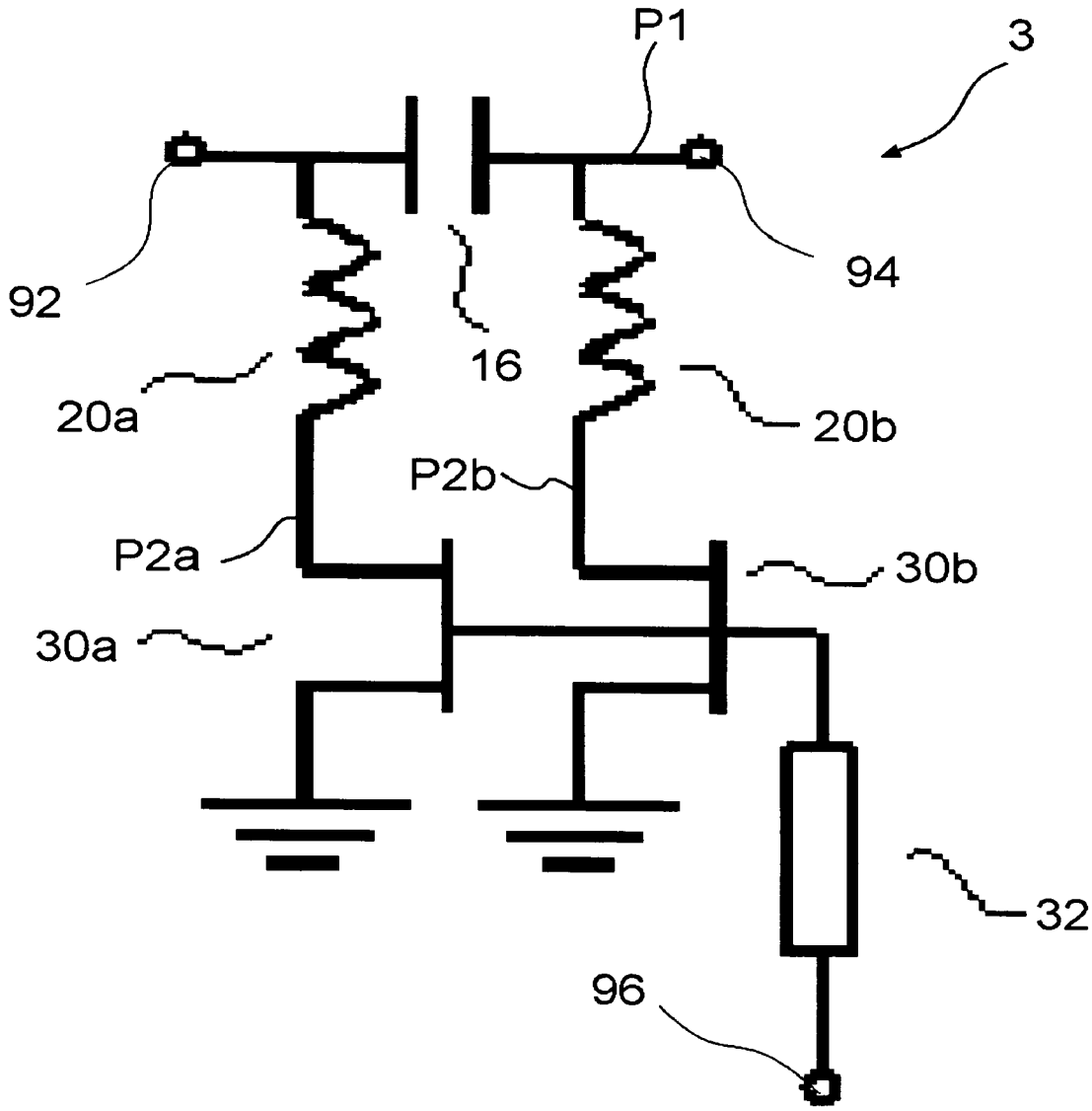
FIG. 6 is a circuit diagram of a switch circuit according to the third embodiment of the present invention.

FIG. 6 is a circuit diagram of a switch circuit according to the third embodiment of the present invention. The switch circuit 3 is a SPST switch that includes a unit circuit including a capacitor 16, inductors 20*a*, 20*b*, and the FETs 30*a*, 30*b*.

In this embodiment, the unit circuit includes two paths P2*a*, P2*b*. The two paths P2*a*, P2*b* are respectively connected to the path P1 at each end of the capacitor 16. The path P2*a* includes the inductor 20*a* and the FET 30*a* serially connected to each other. To be more detailed, the drain (or source) of the FET 30*a* is connected to an end of the inductor 20*a*, and the source (or drain) is grounded. Likewise, the path P2*b* includes the inductor 20*b* and the FET 30*b* serially connected to each other. To be more detailed, the drain (or source) of the FET 30*b* is connected to an end of the inductor 20*b*, and the source (or drain) is grounded. To the gate of the FETs 30*a*, 30*b*, the control terminal 96 is commonly connected via the transmission line 32.

An operation of the switch circuit 3 will be described hereunder, along with a result of operation simulation of the switch circuit 3. In the simulation, the threshold voltage of the FET 30*a*, 30*b* was set at −1 V. The capacitance C of the capacitor 16 was set at 0.05 pF, the inductance L of the inductors 20*a*, 20*b* at 0.22 nH, the OFF capacitance $C_{off}$ of the FETs 30*a*, 30*b* at 0.02 pF, and the ON resistance $R_{on}$ of the FET 30*a*, 30*b* at 13Ω.

Figure 7A:
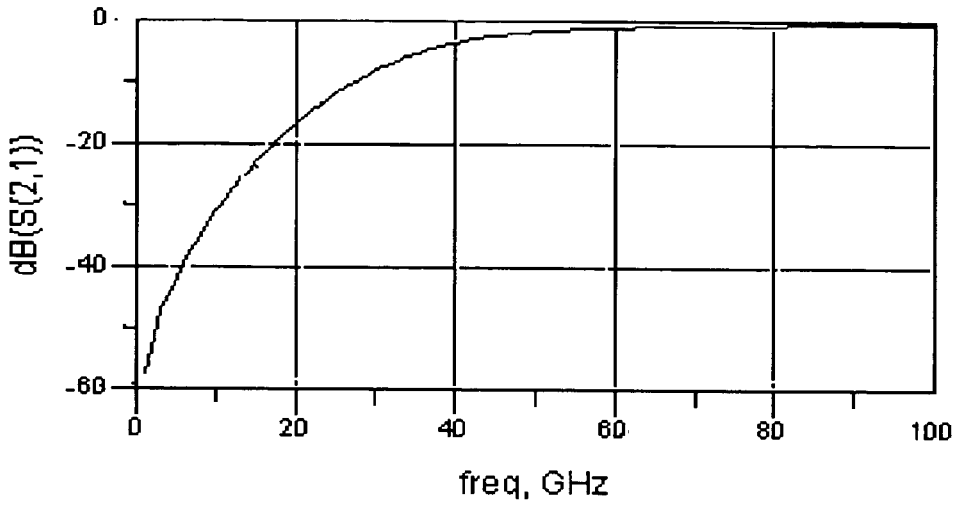
FIGS. 7A and 7B are graphs showing an operation simulation result of the switch circuit of FIG. 6.

Upon applying 0 V to the control terminal 96 the switch circuit 3 is turned ON, and the capacitor 16 and the inductors 20*a*, 20*b* constitute a n-type high-pass filter. The impedance between the I/O terminals 92, 94 comes close to 50Ω at the cutoff frequency (approx. 48 GHz) or higher. Under such state, the transmission characteristic of the RF signal between the I/O terminals 92, 94 is expressed as a small signal frequency characteristic typically seen in a high-pass filter, as shown in FIG. 7A. Thus, a significantly low loss characteristic was achieved, such as 0.52 dB at 76 GHz.

Figure 7B:
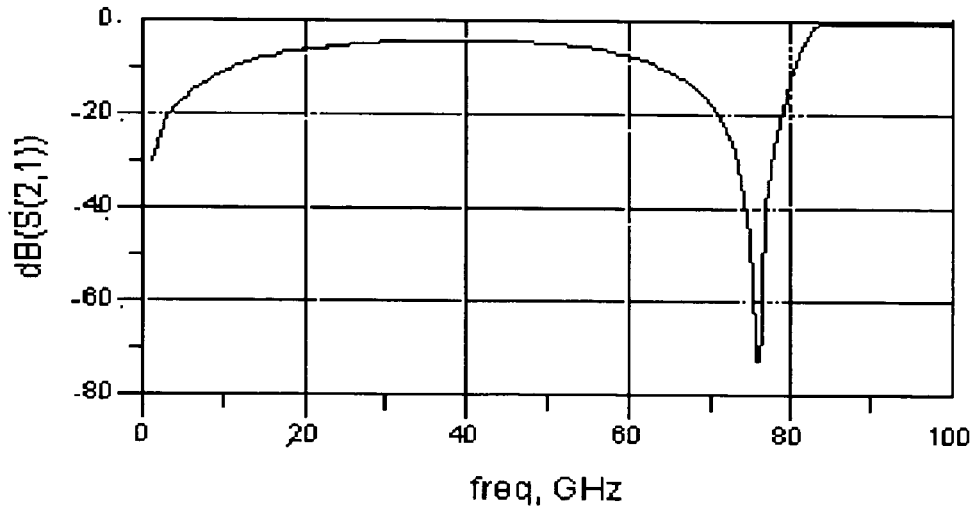

Upon applying, on the other hand, −5V to the control terminal 96, the switch circuit 3 is turned OFF. Because of the serial resonance of the inductors 20*a*, 20*b* and the OFF capacitance of the FETs 30*a*, 30*b*, a short circuit occurs between the I/O terminals 92, 94. Accordingly, the RF signal input through the I/O terminal 92 or the I/O terminal 94 is totally reflected by the connection point, thus to be blocked between the I/O terminals 92, 94. FIG. 7B shows a transmission characteristic of the RF small signal between the I/O terminals 92, 94. From FIG. 7B, it is apparent that at 76 GHz the signal is blocked by the serial resonance of the transmission line 22 and the OFF capacitance of the FET 30. Thus, an isolation characteristic as high as 78.6 dB at 76 GHz was achieved.

The switch circuit 3 thus configured offers the following advantage, in addition to those offered by the switch circuit 1. The switch circuit 3 includes, in the unit circuit, two paths P2*a*, P2*b* respectively connected to the path P1 at each side of the capacitor. Such configuration achieves, as shown in FIG. 7B, a higher isolation characteristic than the switch circuits 1, 2.

FOURTH EMBODIMENT

Figure 8:
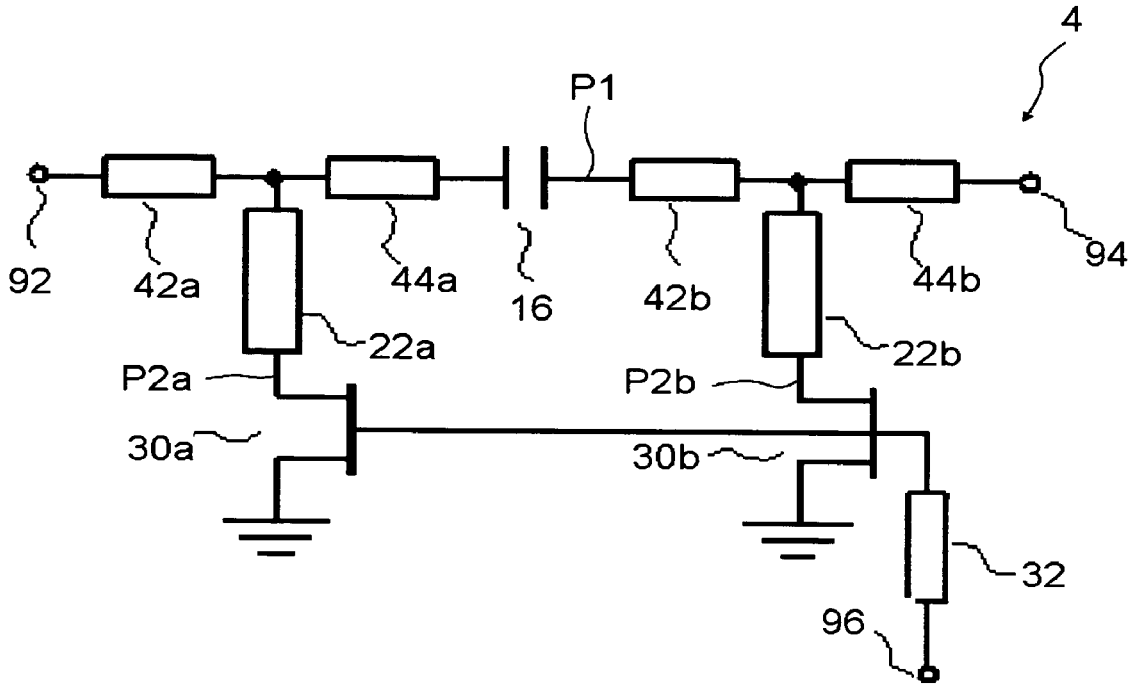
FIG. 8 is a circuit diagram of a switch circuit according to the fourth embodiment of the present invention.

FIG. 8 is a circuit diagram of a switch circuit according to the fourth embodiment of the present invention. The switch circuit 4 is a SPST switch that includes a unit circuit including a capacitor 16, transmission lines 22*a*, 22*b* (inductors), and the FETs 30*a*, 30*b*. The path P1 includes transmission lines 42*a*, 42*b*, 44*a*, 44*b*, in addition to the capacitor 16. The transmission lines 42*a*, 44*a*, the capacitor 16, and the transmission lines 42*b*, 44*b* are serially connected to one another in this sequence.

The path P2*a* includes the transmission line 22*a* and the FET 30*a* serially connected to each other. Likewise, the path P2*b* includes the transmission line 22*b* and the FET 30*b* serially connected to each other. To the gate of the FETs 30*a*, 30*b*, the control terminal 96 is commonly connected via the transmission line 32. The transmission lines 22*a*, 22*b* act as inductors. In other words, the inductors are constituted of distributed constant lines, in the switch circuit 4.

An operation of the switch circuit 4 will be described hereunder, along with a result of operation simulation of the switch circuit 4. In the simulation, a GaAs FET (threshold voltage −1V, gate width 100 μm) having a heterojunction was employed. The GaAs substrate was formed in a thickness of 40 μm. The width and length of the transmission lines 42*a*, 42*b*, 44*a*, 44*b* were set at 25 μm and 30 μm, respectively. The width and length of the transmission lines 22*a*, 22*b* were set at 15 μm and 235 μm respectively. The capacitor 16 was formed in a MIM structure with the width and length of 20 μm and 10 μm respectively, and the capacitance per unit area was set at 300 pF/mm$^2$. Also, the OFF capacitance $C_{off}$ of the FETs 30*a*, 30*b* was set at 0.02 pF, and the ON resistance $R_{on}$ of the FETs 30*a*, 30*b* at 13Ω.

Figure 9A:
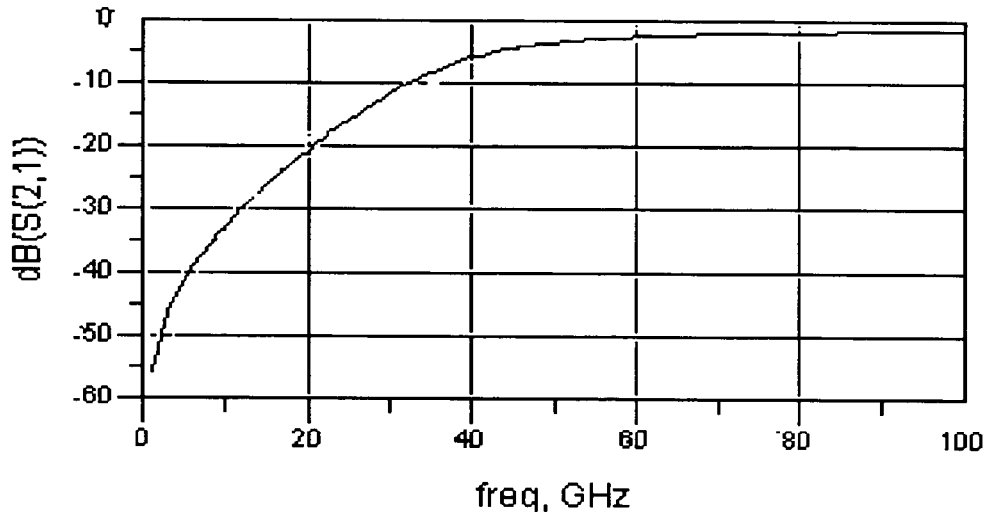
FIGS. 9A and 9B are graphs showing an operation simulation result of the switch circuit of FIG. 8.

Upon applying 0 V to the control terminal 96 the switch circuit 4 is turned ON, and the capacitor 16 and the transmission lines 22*a*, 22*b* constitute a π-type high-pass filter. The impedance between the I/O terminals 92, 94 comes close to 50Ω at the cutoff frequency (approx. 60 GHz) or higher. Under such state, the transmission characteristic of the RF signal between the I/O terminals 92, 94 is expressed as a small signal frequency characteristic typically seen in a high-pass filter, as shown in FIG. 9A. Thus, a significantly low loss characteristic was achieved, such as 1.86 dB at 76 GHz.

Figure 9B:
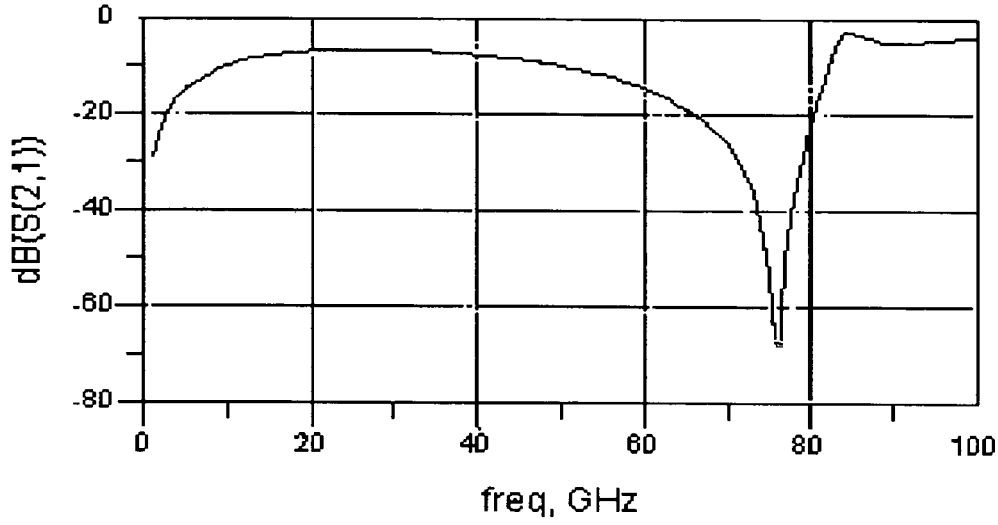

Upon applying, on the other hand, −5V to the control terminal 96, the switch circuit 4 is turned OFF. Because of the serial resonance of the transmission line 22*a*, 22*b* and the OFF capacitance of the FETs 30*a*, 30*b*, a short circuit occurs between the I/O terminals 92, 94. Accordingly, the RF signal input through the I/O terminal 92 or the I/O terminal 94 is totally reflected by the connection point, thus to be blocked between the I/O terminals 92, 94. FIG. 9B shows a transmission characteristic of the RF small signal between the I/O terminals 92, 94. From FIG. 9B, it is apparent that at 76 GHz the signal is blocked by the serial resonance of the transmission lines 22*a*, 22*b* and the OFF capacitance of the FETs 30*a*, 30*b*. Thus, an isolation characteristic as high as 73.9 dB at 76 GHz was achieved.

The switch circuit 4 thus configured offers the following advantage, in addition to those offered by the switch circuit 3. Since the inductor is constituted of a distributed constant line (transmission lines 22*a*, 22*b*) in the switch circuit 4, the switch circuit 4 is particularly suitable for operation under a millimeter-wave band.

FIFTH EMBODIMENT

Figure 10:
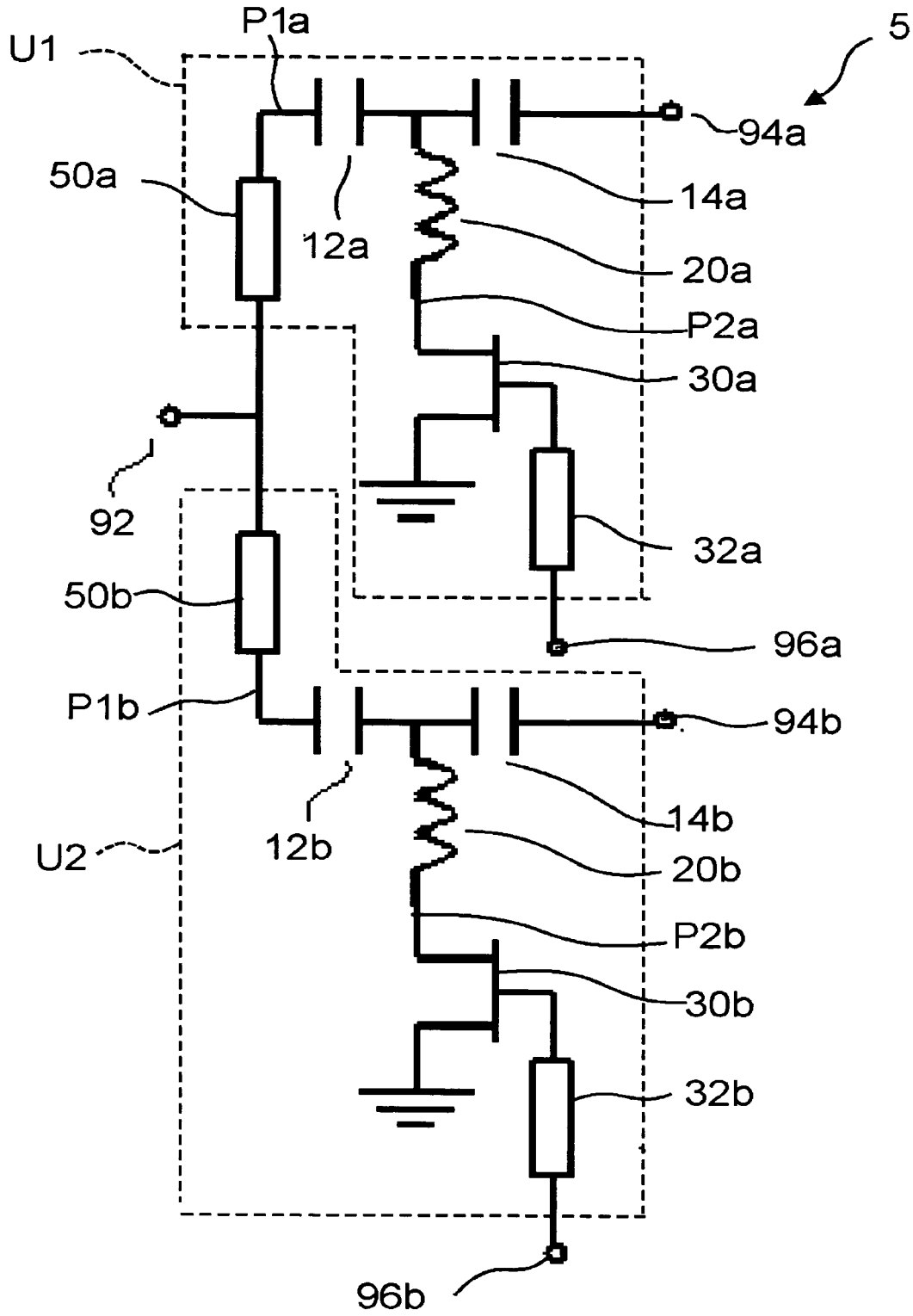
FIG. 10 is a circuit diagram of a switch circuit according to the fifth embodiment of the present invention.

FIG. 10 is a circuit diagram of a switch circuit according to the fifth embodiment of the present invention. The switch circuit 5 is a single pole double throw (hereinafter, SPDT) switch that includes a plurality of unit circuits U1, U2. The unit circuits U1, U2 share the I/O terminal 92. The paths P1*a*, P1*b* respectively provided in the unit circuits U1, U2 each include a transmission line 50*a* or 50*b*. The transmission lines 50*a*, 50*b* are λ/4 lines having a length equal to a quarter of the propagation wavelength of the operating frequency, with an end connected to the I/O terminal 92. The remaining portion of the unit circuits U1, U2 is similarly configured to the circuit described referring to FIG. 1.

Figure 11:
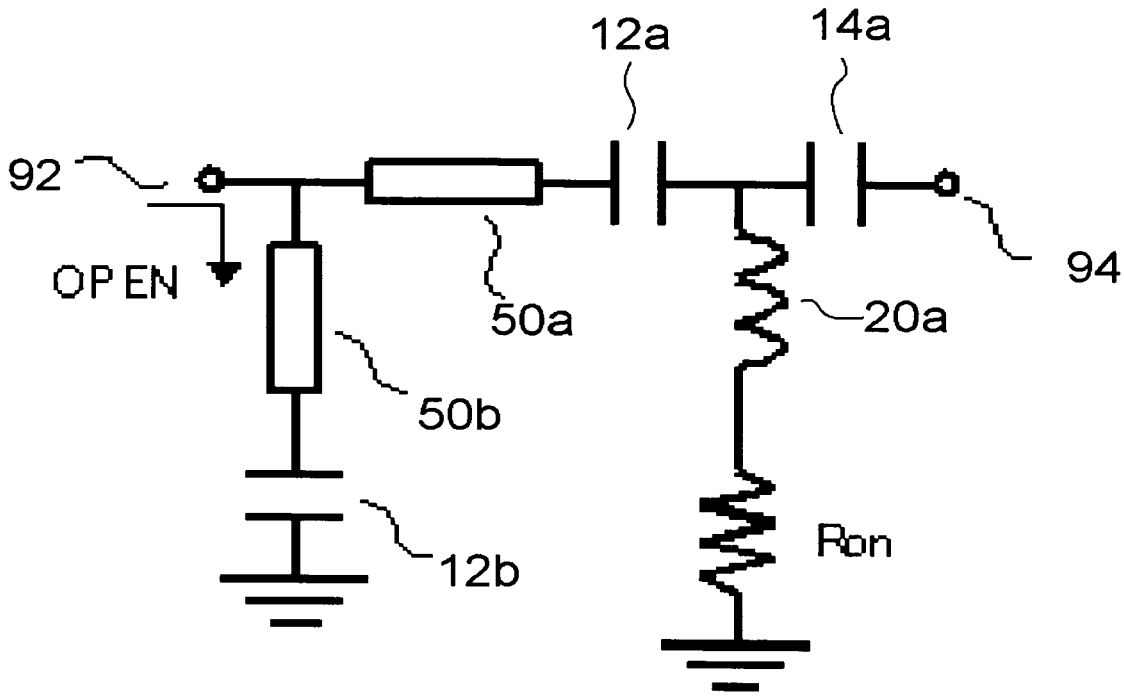
FIG. 11 is an equivalent circuit diagram of the switch circuit of FIG. 10.

The switch circuit 5 operates as follows. In the switch circuit 5, complementarily switching the high and low level of the voltage applied to the control terminals 96*a*, 96*b* allows switching the channel through which the signal is transmitted. For example, upon applying 0 V to the control terminal 96*a* and −5 V to the control terminal 96*b*, the portion between the I/O terminals 92, 94*a* serves as an ON branch, and the portion between the I/O terminals 92, 94*b* serves as an OFF branch. An equivalent circuit under such state is shown in FIG. 11. The OFF branch is grounded via the transmission line 50*b* and the capacitor 12*b*. This is because the inductor 20*b* and the FET 30*b* of the OFF branch are in serial resonance, and hence the capacitor 12*b* becomes short-circuited at the connection point with the inductor 20*b*. Setting the capacitance of the capacitor 12*b* at a value that causes short circuit at the operating frequency makes the OFF branch appear to be open at the connection point between the I/O terminal 92 and the transmission line 50*a*, through the transmission line 50*b*.

In the ON branch, on the other hand, a T-type high-pass filter is formed as described regarding the switch circuit 1. Since the ON branch is constituted of such T-type high-pass filter with the transmission line 50*a* connected thereto, the RF signal can be transmitted with low loss without loss of signal in the OFF branch. In the switch circuit 5, switching the voltage to be applied to the control terminals 96*a*, 96*b* allows switching the ON and OFF branches. After such switching, the switch circuit 5 operates as described above, except that the portion between the I/O terminals 92, 94*a* is substituted with the OFF branch, and the portion between the I/O terminals 92, 94*b* with the ON branch.

The switch circuit 5 thus configured provides a SPDT switch that offers the similar advantages to those of the switch circuit 1. Here, although the T-type circuit described regarding the first embodiment is employed in the unit circuit in this embodiment, the T-type circuit according to the second embodiment may be employed, and alternatively the π-type circuit according to the third or fourth embodiment may be employed. Further, the switch circuit according to the present invention may be expanded to a SPnT switch, or a m-pole n-throw (hereinafter, mPnT) switch, by a similar method to this embodiment.

SIXTH EMBODIMENT

Figure 19:
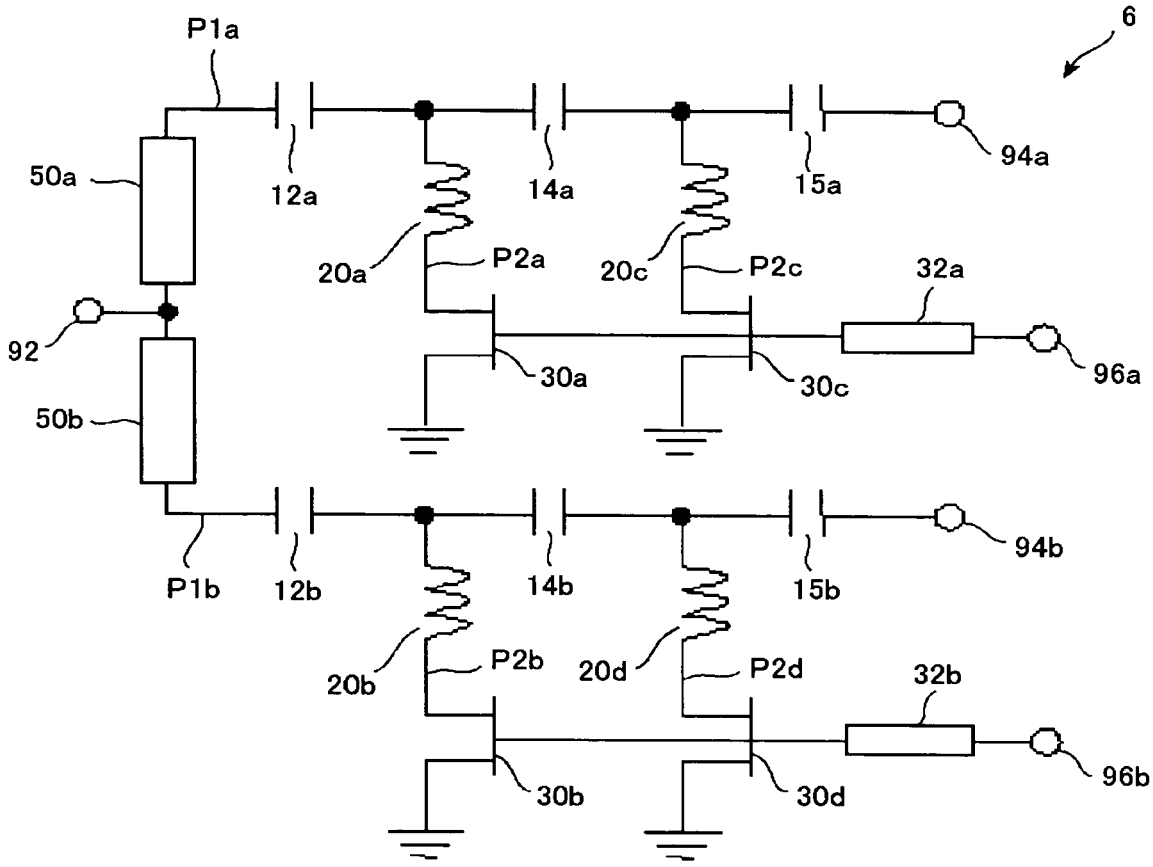
FIG. 19 is a circuit diagram of a switch circuit according to the sixth embodiment of the present invention.

FIG. 19 is a circuit diagram of a switch circuit according to the sixth embodiment of the present invention. The switch circuit 6 is a SPDT switch that includes a plurality of unit circuits like the switch circuit 5 shown in FIG. 10. The switch circuit 6 is different from the switch circuit 5 in that the former includes a plurality of unit circuits in each branch. To be more detailed, the branch on the side of the path P1*a* includes two unit circuits configured as shown in FIG. 1, which are serially connected. This also applies to the branch on the side of the path P1*b*. In other words, the switch circuit 6 includes a plurality of unit circuit groups respectively including a plurality of unit circuits serially connected to one another, so that the plurality of unit circuit groups share the I/O terminal 92. Also, the paths P1*a*, P1*b* in each unit circuit group respectively include the transmission line 50*a* or 50*b*, an end of which is connected to the I/O terminal 92. The remaining portion of the switch circuit 6 is similarly configured to the switch circuit 5.

The two unit circuits serially connected each other in each branch share the capacitor located therebetween. Specifically, in the branch on the side of the paths P1*a*, P1*b*, the capacitors 14*a*, 14*b* are respectively shared. Accordingly, in the branch on the side of the path P1*a* the capacitors 12*a*, 14*a*, the inductor 20*a*, the FET 30*a* and the transmission line 32*a* constitute one of the unit circuits, and the capacitors 14*a*, 15*a*, the inductor 20*c*, the FET 30*c* and the transmission line 32*a* constitute the other unit circuit. Likewise, in the branch on the side of the path Plb the capacitors 12*b*, 14*b*, the inductor 20*b*, the FET 30*b* and the transmission line 32*b* constitute one of the unit circuits, and the capacitors 14*b*, 15*b*, the inductor 20*d*, the FET 30*d* and the transmission line 32*b* constitute the other unit circuit.

In the switch circuit 6, similar parameters, such as the capacitance value, to those cited referring to the switch circuit 1 may be adopted, and the operation of the switch circuit 6 is also similar to that of the switch circuit 5.

The switch circuit 6 thus configured provides a SPDT switch that offers the similar advantages to those of the switch circuit 1. Here, although the T-type circuit described regarding the first embodiment is employed in the unit circuit in this embodiment, the T-type circuit according to the second embodiment may be employed, and alternatively the π-type circuit according to the third or fourth embodiment may be employed. When employing the π-type circuit, one of the unit circuits adjacently located may be omitted, because just one unit circuit can still provide the similar advantage. Further, although two unit circuits are provided in each branch in this embodiment, three or more unit circuits may be provided. The switch circuit according to the present invention may be expanded to a SPnT switch, or mPnT switch, by a similar method to this embodiment.

Figure 12:
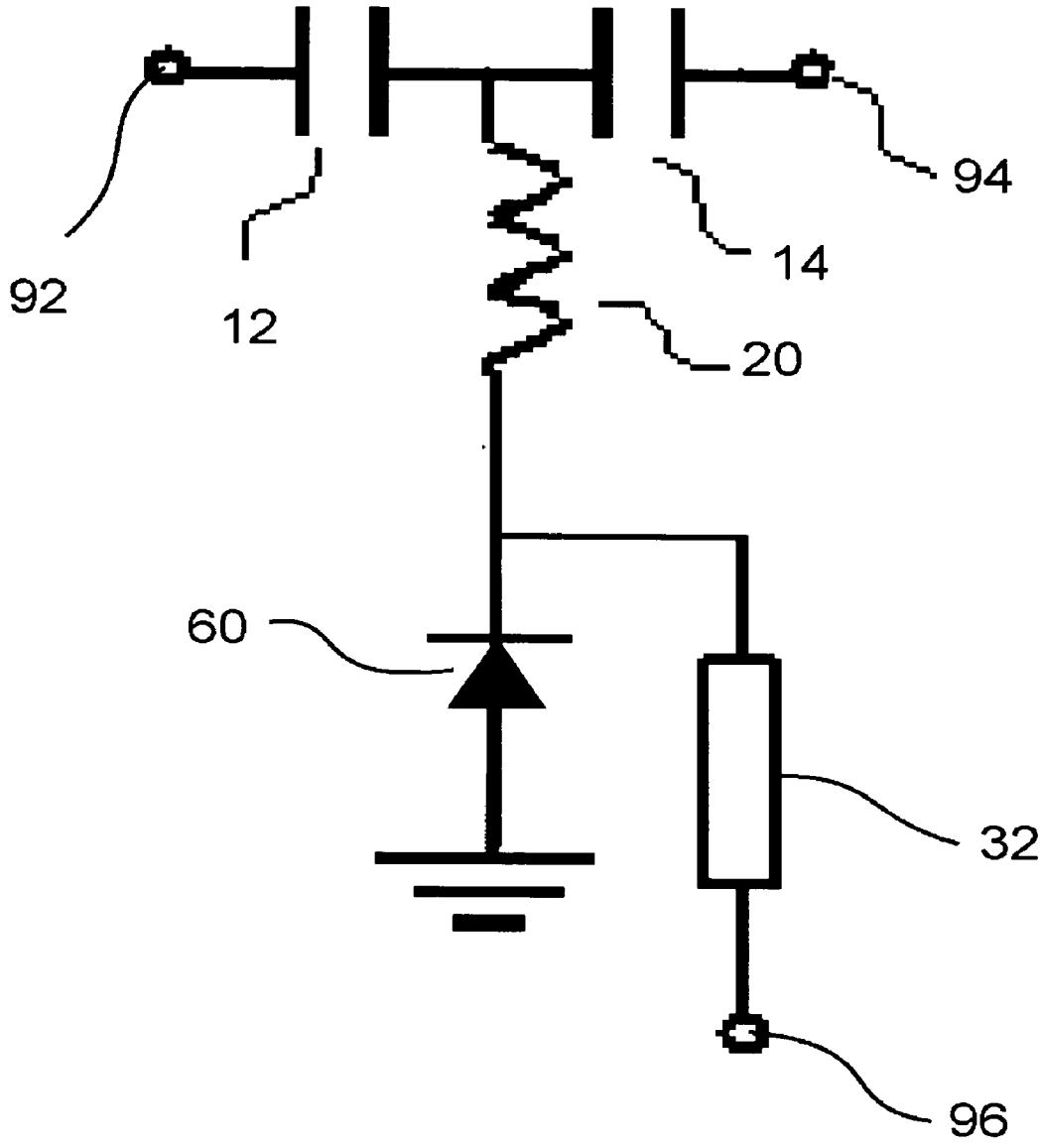
FIG. 12 is a circuit diagram of a switch circuit according to a variation of the embodiment.

The switch circuit according to the present invention is not limited to the foregoing embodiments, but various modifications may be made. To cite a few examples, a diode may be employed in place of the FET, in the respective embodiments. FIG. 12 is a circuit diagram of the switch circuit of FIG. 1, in which the FET 30 is substituted with a diode 60. In FIG. 12, the anode of the diode 60 is grounded, and the cathode thereof is connected to the inductor 20. The cathode of the diode 60 is also connected to the control terminal 96 via the transmission line 32. In the circuit shown in FIG. 12, the diode 60 may be reversely oriented. In other words, the cathode of the diode 60 may be grounded and the anode thereof may be connected to the inductor 20.

Figure 13:
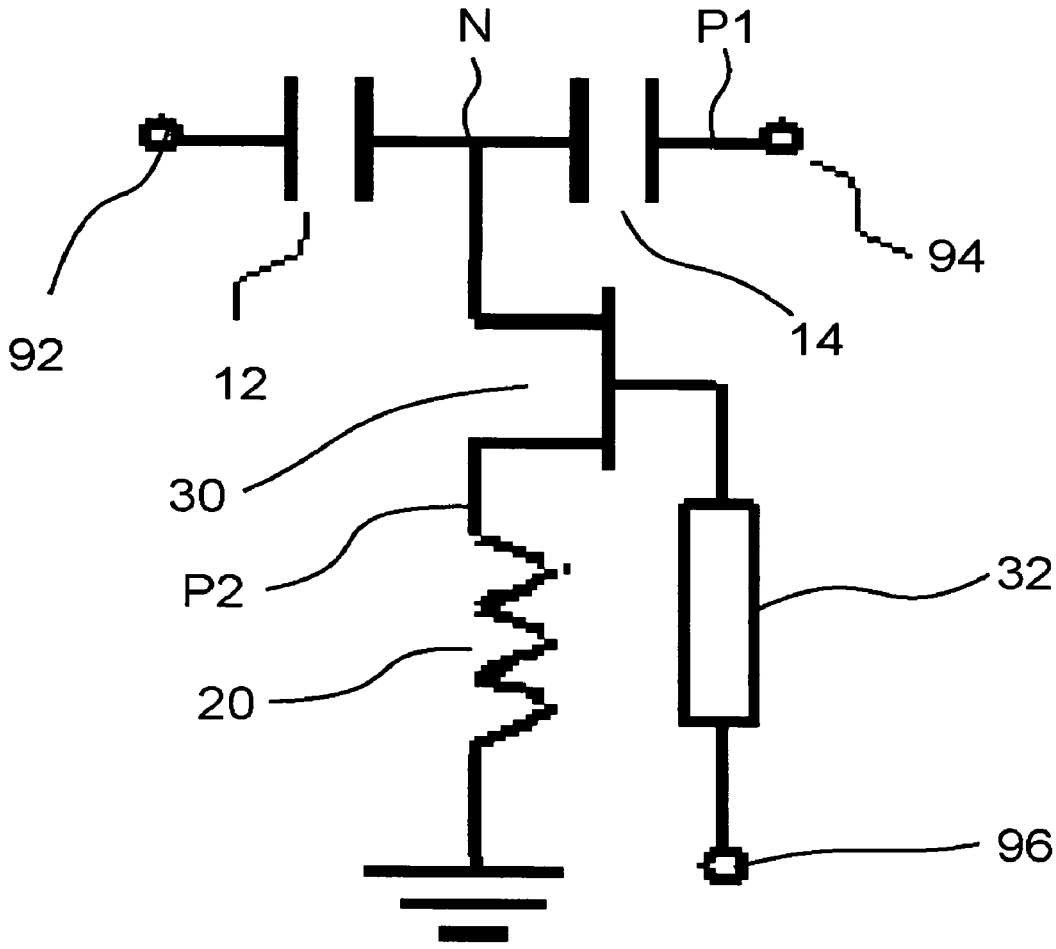
FIG. 13 is a circuit diagram of a switch circuit according to another variation of the embodiment.

Also, in the respective embodiments, a capacitance between interconnects may be employed as the capacitor. In those embodiments, also, the location of the inductor (or transmission line serving as the inductor) may be exchanged with that of the FET in the paths P2, P2*a*, P2*b*. FIG. 13 is a circuit diagram of the switch circuit of FIG. 1, in which the locations of the inductor 20 is exchanged with that of the FET 30. In FIG. 13, the drain (or source) of the FET 30 is connected to the connection point N, and an end of the inductor 20 is connected to the source (or drain) of the FET 30. The other end of the inductor 20 is grounded.

Figure 14:
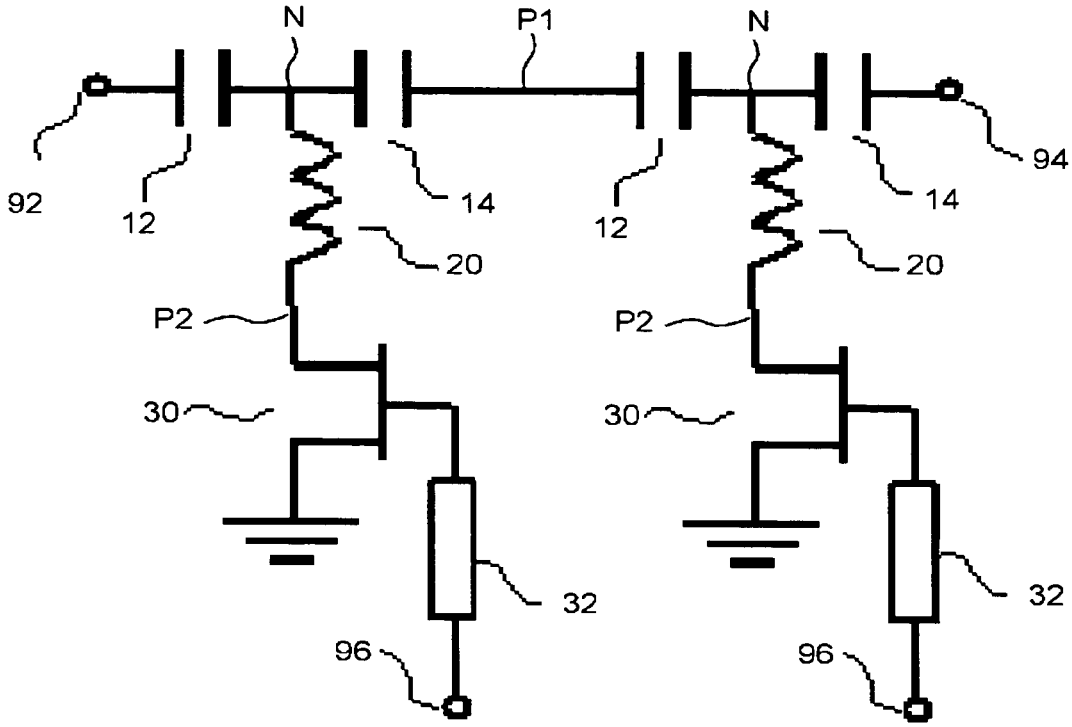
FIG. 14 is a circuit diagram of a switch circuit according to still another variation of the embodiment.

Further, in the foregoing embodiments, a plurality of unit circuits serially connected to one another may be provided. FIG. 14 is a circuit diagram of the switch circuit of FIG. 1, in which two unit circuits are serially connected to each other. Such configuration enables further improving the isolation characteristic of the switch circuit.

It is apparent that the present invention is not limited to the above embodiment, and may be modified and changed without departing from the scope and spirit of the invention.

What is claimed is:

1. A switch circuit comprising a unit circuit, including:

a first capacitor and a second capacitor provided in a first path connecting input/output terminals;

an inductor provided in a second path having an end connected to said first path and the other end grounded; and a switching element provided in said second path and serially connected to said inductor, wherein the first capacitor and the second capacitor are serially connected to each other, and a connection point of said first path and said second path is located between the first capacitor and the second capacitor.

2. The switch circuit according to claim 1, wherein said unit circuit includes two of said second paths respectively connected to said first path at each side of said first capacitor.

3. The switch circuit according to claim 1, comprising:

a plurality of said unit circuits;

wherein said plurality of the unit circuits are serially connected to one another.

4. The switch circuit according to claim 3, comprising:

a plurality of unit circuit groups respectively including said plurality of unit circuits serially connected to one another;

wherein said plurality of the unit circuit groups share one of said input/output terminals; and said first path of each of said plurality of the unit circuit groups includes a ¼ wavelength line having an end connected to said one of said input/output terminals.

5. The switch circuit of claim 4, wherein each of the plurality of the unit circuits serially connected to one another shares at least one of its respective first capacitor and second capacitor with another unit circuit among the plurality of the unit circuits to which it is serially connected.

6. The switch circuit according to claim 1, comprising:

a plurality of said unit circuits;

wherein said plurality of the unit circuits share one of said input/output terminals; and said first path of each of said plurality of the unit circuits includes a ¼ wavelength line having an end connected to said one of said input/output terminals.

7. The switch circuit according to claim 1, wherein said inductor is constituted of a distributed constant line.

8. The switch circuit according to claim 1, wherein said switching element is a field effect transistor; and a gate of said field effect transistor is connected via an RF isolation circuit to a control terminal to which a control voltage for switching said field effect transistor ON or OFF is input.

9. The switch circuit according to claim 1, wherein said switching element is a diode; and one of an anode or a cathode of said diode is grounded, and the other is connected via an RF isolation circuit to a control terminal to which a control voltage for switching said diode ON or OFF is input.

* * * * *